United States Patent [19]

Dudley

[11] Patent Number: 4,778,186

[45] Date of Patent: Oct. 18, 1988

[54] BOARD GAME

[76] Inventor: Irene Dudley, 33 Alecia Street, Southport, Australia, Q 4215

[21] Appl. No.: 936,590

[22] Filed: Dec. 1, 1986

[30] Foreign Application Priority Data

Jun. 20, 1986 [AU] Australia ..... PH 06501

[51] Int. Cl.[4] ..... A63F 3/00

[52] U.S. Cl. ..... 273/243; 273/142 R

[58] Field of Search ..... 273/242, 243, 248, 249, 273/250, 253, 280, 142 R

[56] References Cited

U.S. PATENT DOCUMENTS

| | | | |
|---|---|---|---|
| 2,215,696 | 9/1940 | Graves | 273/280 X |
| 2,839,303 | 6/1958 | Baker | 273/280 X |
| 3,191,938 | 6/1965 | Smith | 273/142 R |
| 3,746,344 | 7/1973 | Hodan | 273/243 |
| 3,785,654 | 1/1974 | Chambers | 273/249 |
| 4,359,226 | 11/1982 | Neff | 273/243 |

FOREIGN PATENT DOCUMENTS

| | | | |
|---|---|---|---|
| 2037591 | 7/1980 | United Kingdom | 273/243 |

*Primary Examiner*—Richard C. Pinkham

*Assistant Examiner*—Jessica J. Harrison

*Attorney, Agent, or Firm*—Murray and Whisenhunt

[57] ABSTRACT

Board game including a board provided with an annular path along which player's tokens may advance, the annular path being arranged concentrically about a central pivot axis and being divided into twelve equal segments each representing a respective one of twelve astrological house signs. A pair of segmented wheels are mounted for independent rotation about the central pivot axis and are arranged whereby the segmented portion of each wheel is visible. Each segmented wheel is divided into twelve equal segments, each of the segments of one wheel designating a respective one of twelve zodiac signs and the segments of the other wheel designating planet signs. An alignment indicator is associated with each segment of the wheels for indicating an operative scoring alignment between the wheel segments and the path segments. In this way, the wheels may be spun independently to provide random alignment of the alignment indicator with a house sign segment to provide random combinations of zodiac signs and planet segments.

6 Claims, 6 Drawing Sheets

AWARDS FOR LIBRA

| | | |
|---|---|---|
| ☉ | Charming, graceful, popular with high principles | +4 |
| ☽ | Strong Sensitivity to partners. | +3 |
| ☿ | Try to make up mind much quicker | 0 |
| ♀ | Seek harmony in social and marriage partnerships | +5 |
| ♂ | Strong urge to compete and win at all costs | −3 |
| ♃ | Great concerne with justice | +2 |
| ♅ | Dislike being tied down in relationships | −4 |
| ♄ | Too Indecisive | −1 |
| ♆ | Intuitive awareness in Social relationships | +1 |
| ♇ | Not aware of responsability to fellow humans. | −5 |
| Bonus: If Venus is in Libra in the 7th house | | +6 |

LIBRA RULED BY VENUS

Relates to Harmony & Balance

♎

Ruled by ♀

Date: Sept 23rd - Oct 22nd

Cardinal Sign.

Element Air.

Colour: Blue/Green.

FIG. 6

BOARD GAME

This invention relates to board games and in particular it relates to an astrological board game.

BACKGROUND OF THE INVENTION

Many board games are available, ranging from very simple games suitable only for young children to very complicated games for adults. In the simpler games the progress of each player is determined only by the throw of dice while in the more difficult games, complex rules and maneuvers test players' skills to the limit. In simple board games the game cycle time is generally short and mostly such games are not of interest to mature players. On the other hand the more complex board games may be too difficult for young players. Very few board games have been designed which are suitable for family entertainment such that they can be easily played by advancing in accordance with the throw of dice and by following instructions on the game board while at the same time providing a game for adults or mature players based on a theme which will maintain their interest.

Many board games have been proposed in the past including astrological board games such as those illustrated in U.S. Pat. Nos. 2,549,495, 3,652,092 and 3,796,432. While these may operate effectively it is considered that they would be of interest only to persons having a good understanding of astrology and the zodiac.

This invention aims to alleviate the abovementioned disadvantages and to provide a board game based on astrology which will be interesting and fun to play. Other objects and advantages of this invention will hereinafter become apparent.

SUMMARY OF THE INVENTION

With the foregoing and other objects in view, this invention in one aspect resides broadly in a board game having a segmented path along which players may advance through astrological houses and there being provided zodiac signs and/or indications and planet signs and/or indications which may be randomly aligned with the respective houses to provide combinations of zodiac signs and houses or zodiac signs, planets and houses which will have selected values and so determine the progress of the players' tokens along the segmented path. Preferably the segmented path is arranged concentrically about a central pivot axis and both the zodiac signs and the planets are arranged in equally spaced relationship around respective wheels rotatable about the central pivot axis so that each zodiac sign and/or planet may randomly align with any one of the respective houses. Of course if desired the zodiac signs and/or indications and planets could be adapted to move slidably with respect to the astrological house positions and random selection of their positions may be determined by the throw of a die or dice or electronically if required. Furthermore, the game of the present invention can be used with themes other than astrology and this invention embraces such variations.

In the preferred form of this invention, the wheels upon which the zodiac signs and planets are designated are sprocket or star like with each designation zone extending between a pair of adjacent valleys of the wheel perimeter and whereby each tooth forms a radially extending pointer to indicate the random alignment achieved upon spinning both wheels. The segmented path may include segments having instructions thereon relating to the players movement along the path or their progress in the game. These instructions may include selection of chance cards which may have instructions for increasing or setting back the player's token along the segmented path or the players progress in the game. In one form of the invention each player receives awards upon passing a selected position on the path and/or in accordance with instructions on the chance cards. The winner of the game may be the first player to accumulate the necessary number of awards or otherwise as selected by the players.

In a further aspect this invention resides in a board game having a segmented path concentric with a mounting axle and one or more wheels mounted on the axle and adapted to be spun to stop randomly at designated points of coincidence whereby selected scores are achieved.

BRIEF DESCRIPTION OF THE DRAWINGS

In order that this invention may be more readily understood and put into practical effect, reference will now be made to the accompanying drawings which illustrate a preferred embodiment of the invention and wherein:

FIG. 6 collectively illustrates the front and back of a star card showing the scoring system, and FIG. 7 illustrates a card of rules.

DETAILED DESCRIPTION OF THE INVENTION

Figure 1:
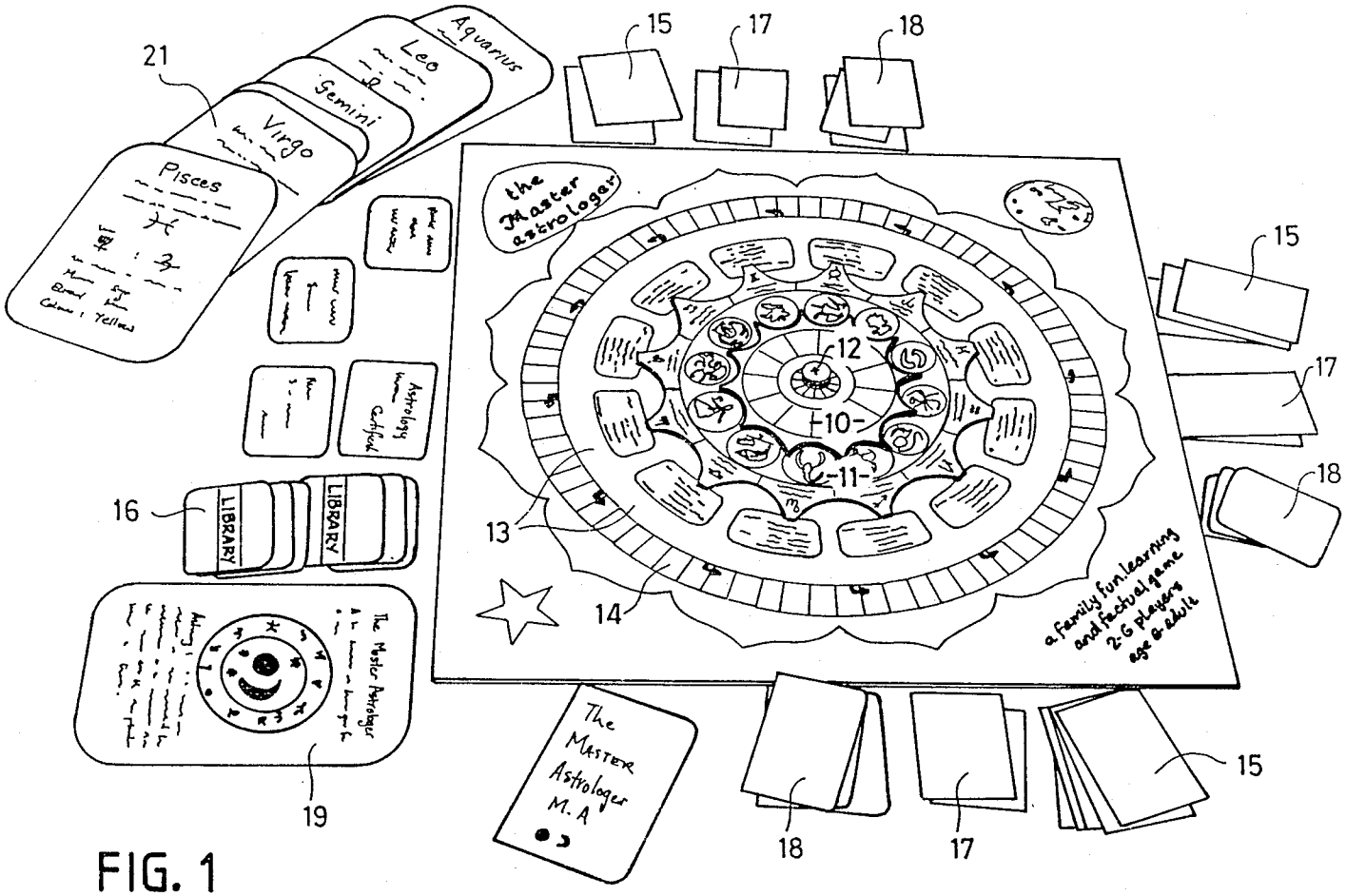
FIG. 1 is an overall view of the game board and associated cards.
Figure 2:
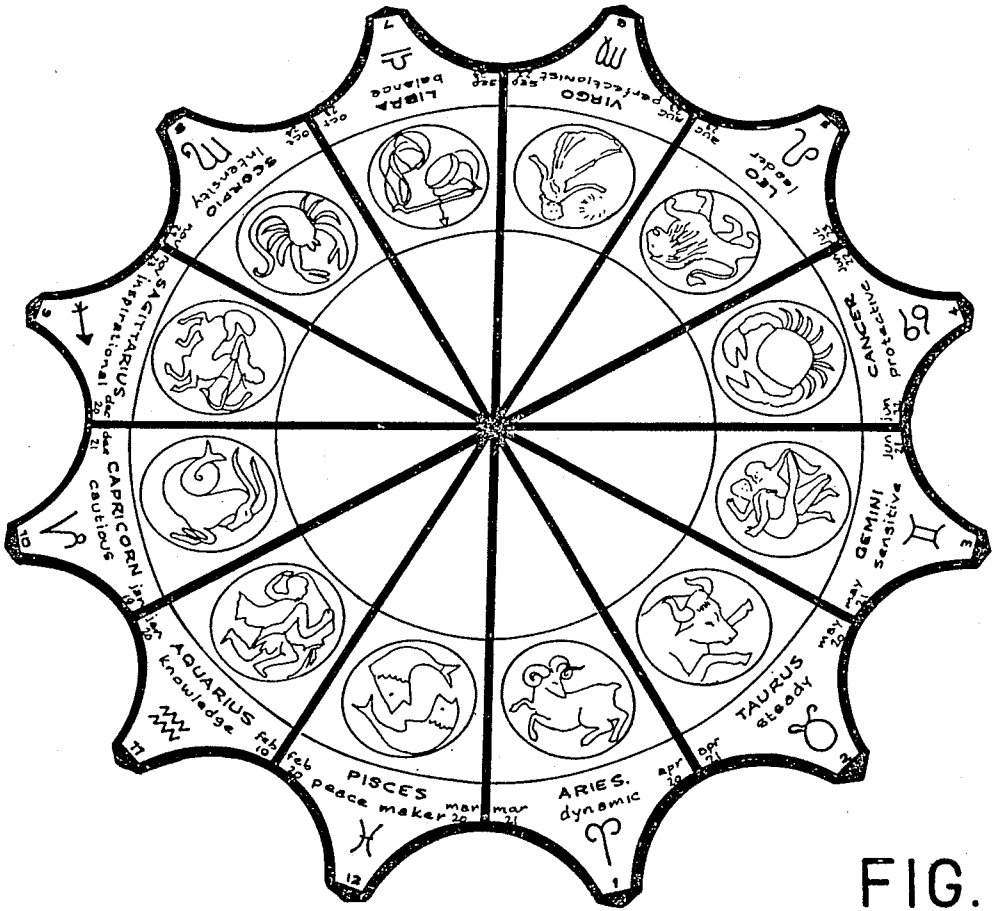
FIG. 2 illustrates the wheel which carries the zodiac signs.
Figure 3:
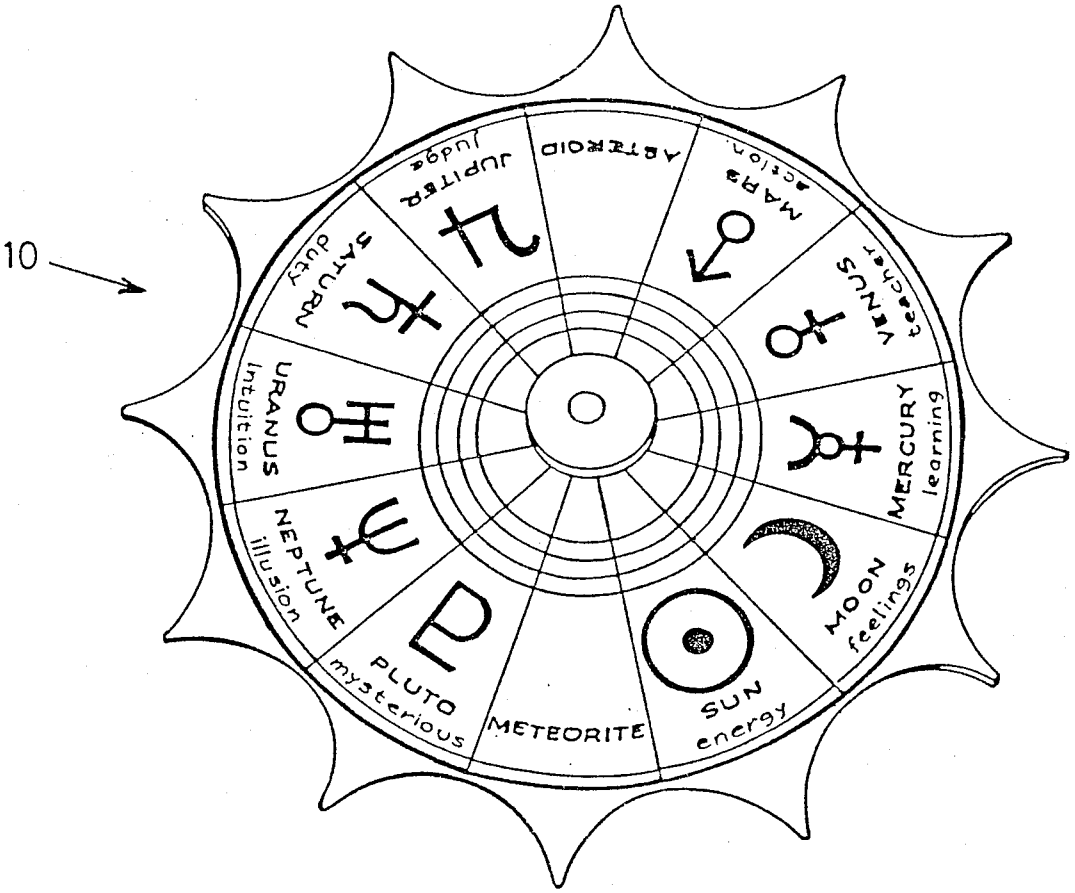
FIG. 3 illustrates the wheel which carries the planet signs.
Figure 4:
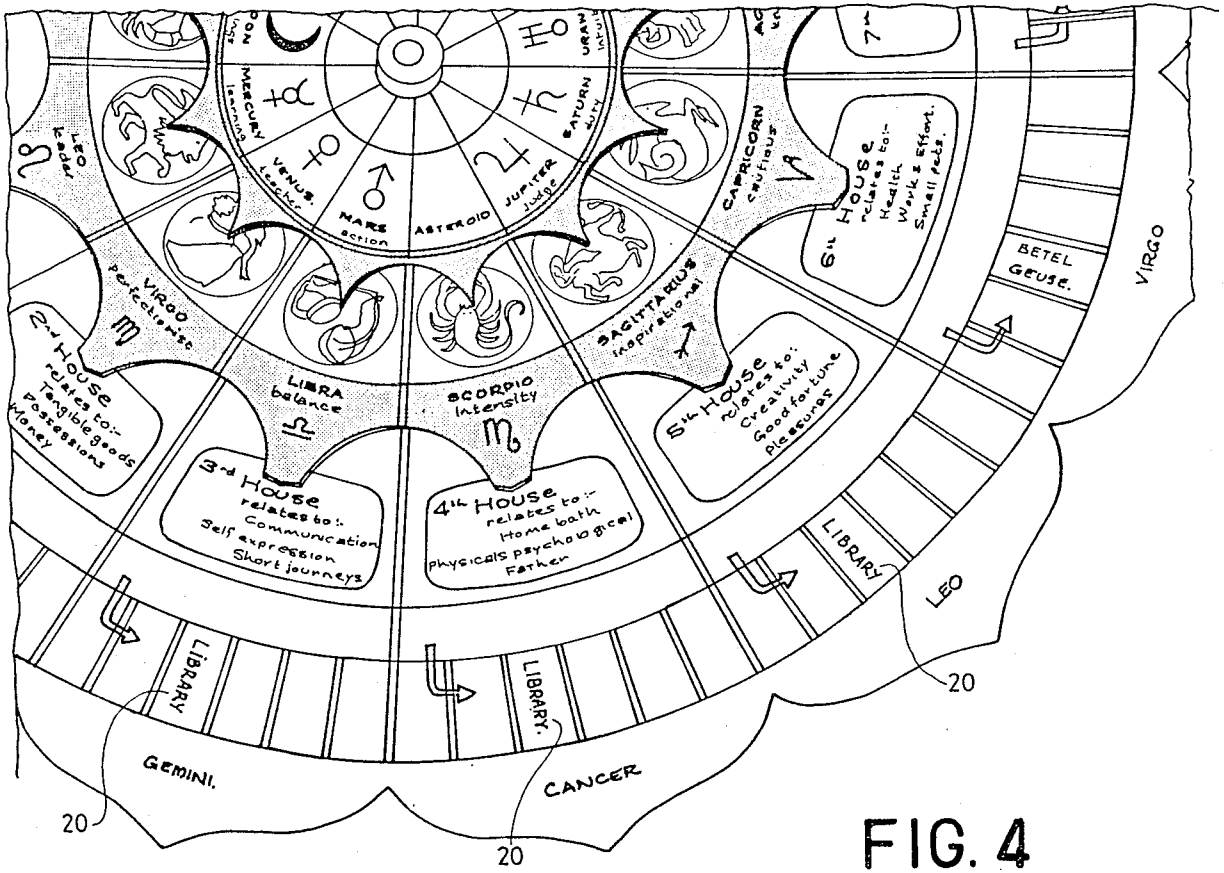
FIG. 4 is an enlarged segment of the game board illustrated in FIG. 1.
Figure 5:
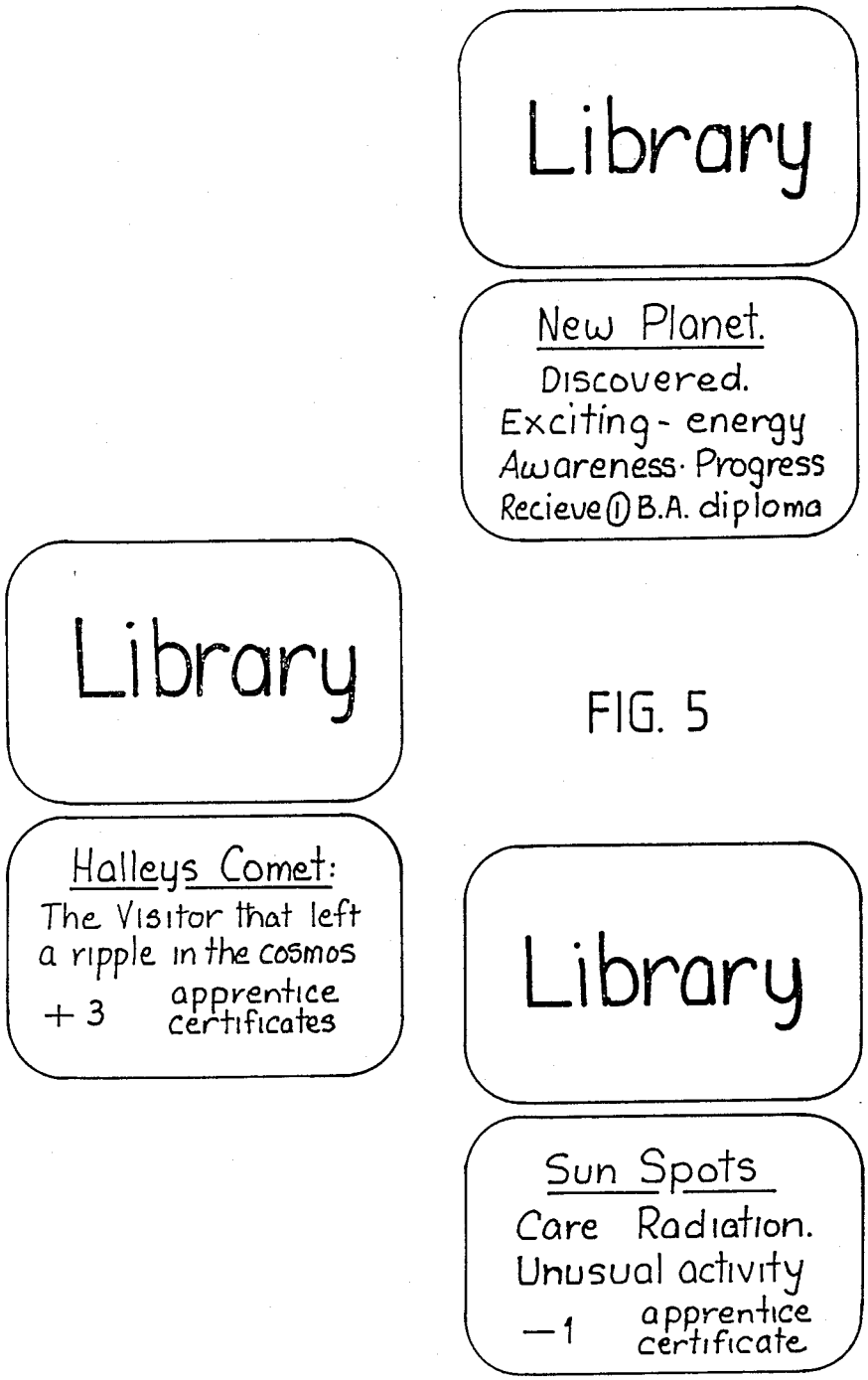
FIG. 5 illustrates typical instructions on the back of chance cards, designated "Library" on the normally visible front face.

As can be seen in FIG. 1 the wheels 10 and 11 carrying the planet and zodiac signs respectively are rotatable about a central axle 12. The smallest wheel, the planet wheel 10 is provided with twelve pointers and corresponding segments designated with the ten planet signs and two segments designated "Asteroid" and Meteorite. The planet wheel 10 overlies the larger zodiac wheel 11 which is provided with twelve points and corresponding segments for the appropriate zodiac or star signs. The pointers of the star wheel extend into house zones 13 of which there are twelve and a segmented annular path 14 extends around the outside of the house zones 13. The segmented path 14 advances six segments per house and in this embodiment there is provided approximately one library segment per house. The house segments may include information relevant to that particular house and it may also be indicated by the particular glyph and the birth date span to which that house relates.

Each player is provided with a token corresponding to their particular house in accordance with their birth date at the start of play and each player's token is placed in the leading segment in their respective house. The tokens may be shaped to correspond to their zodiac sign. At the start of play each player is provided with a selected number of "Apprentice" cards 15, for example ten, and there are also provided "Library" cards 16, "Diploma" cards 17, "Bachelor" cards 18, and one "Master Astrologer" card 19. A player may gain an "Apprentice" card by completing a circuit of the segmented path 14 and selected numbers of "Apprentice" cards will enable that player to gain a "Diploma" card or "Bachelor" cards. Similarly, selected number of "Diploma" or "Bachelor" cards will entitle a player to the "Master Astrologer" card. The game is played with an aim to becoming the "Master Astrologer" and thus the winner of the game.

Initially each player moves in accordance with the throw of a die or dice and advances segmentally along the path 14 according to the number indicated by the die or dice. If the player's token should land on a library segment 20 then the player selects the top library card from a stack of library cards. Each is provided with various instructions relating to receiving or losing selected numbers of qualification cards. The dice is then passed to the next player. After the token has been moved in accordance with the throw of the die or dice the active player then spins the zodiac wheel 11 then the planet wheel 12, whereby selected segments thereof will align with the house in which the players token resides at any stage of the game.

The player then refers to the score or "Star" cards 21, as illustrated in FIG. 7, for the star sign indicated by the house occupied by the player's token. The front of the "Star" card may indicate relevant information about that particular star sign while the back of the star card provides various scores appropriate to alignment between the star and the respective planets. The player then moves in accordance with the score against the appropriate planet sign. As well as designating the number of forward or reverse moves to be made along the segmented path, these star cards 21 may also have information relation to characteristics attributed to alignment of the particular planet and star signs so as to provide educational material which can be enjoyed during the progress of the game. These cards may also provide a bonus when the respective house coincides with a sign which is ruled by the indicated planet. For example if Mercury and Virgo are both aligned in the sixth house the player may receive a further bonus in addition to the moves indicated for that particular alignment.

From the above it will be seen that a player may advance around the board collecting "Apprentice" awards. A selected number, for example six, may be exchanged for a "Diploma" award, and for example six "Diploma" awards may be exchanged for a "Bachelor" award. When a player has for example six "Bachelor" awards he is entitled to the "Master Astrologer" award and becomes the winner of the game.

The above described board game can also be used as an instructional device or as a game which may be played by one or more players simply for the purpose of familiarizing themselves with characteristics of astrology. In such a game there will not be a need for a winner and the game can simply proceed for as long as the players require.

Of course it will be realised that the above has been given only by way of illustrative example of the present invention and that all such modifications and variations thereto as would be apparent to persons skilled in the art are deemed to fall within the broad scope and ambit of this invention as is defined in the appended claims.

I claim:

1. A board game, comprising:

a board provided with an annular path along which players' tokens may advance, said annular path being arranged concentrically about a central pivot axis and being divided into twelve equal path segments each representing a respective one of twelve astrological house signs;

a pair of segmented wheels mounted for independent rotation about said central pivot axis and arranged whereby the segmented portion of each said segmented wheel is visible, each said segmented wheel being divided into twelve equal wheel segments, each of the wheel segments of one said wheel designating a respective one of twelve zodiac signs and the wheel segments of the other said wheel designating planet signs; and alignment indication means associated with each wheel segment for indicating an operative scoring alignment between said wheel segments and said path segments whereby said wheels may be spun independently to provide random alignment of said indication means with a said house sign segment to provide random combinations of zodiac signs and planet signs and wherein each said segmented wheel is sprocket-like and each said segment thereon is aligned with a respective tooth of the respective said sprocket-like wheels, said teeth forming respective radially extending pointers which constitute said alignment indication means.

2. A board game according to claim 1, wherein said annular path includes segments having instructions thereon relating to a player's movement along the path.

3. A board game according to claim 2, wherein said instructions include instructions to select chance cards which have further instructions for advancing or setting back a player's token along the segmented path or the player's progress in the game.

4. A board game according to claim 3, wherein awards are provided for distribution to a player upon passing a selected position on the path and/or in accordance with instructions on said chance cards.

5. A board game according to claim 4, wherein there is provided a "Master Astrologer" certificate which is awarded to the first player who accumulates a selected number of said awards.

6. A board game, comprising:

a board provided with an annular path along which players' tokens may advance, said annular path being arranged concentrically about a central pivot axis and being divided into a selected number of equal path segments having differentiating markings thereon;

a pair of segmented wheels mounted for independent rotation about said central pivot axis and arranged whereby the segmented portion of each said wheel is visible, each said segmented wheel being divided into the selected number of equal wheel segments each having differentiating markings thereon, each said segmented wheel being provided with projecting pointers which form alignment means associated with each wheel segment for indicating an operative scoring alignment between said wheel segments and said path segments

* * * * *